US005829058A

United States Patent [19]

Dicker et al.

[11] Patent Number: 5,829,058

[45] Date of Patent: Nov. 3, 1998

[54] ENERGY EXPENDITURE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 962,721

[22] Filed: Nov. 3, 1997

[51] Int. Cl.[6] ..... A41D 1/06

[52] U.S. Cl. ..... 2/69; 2/227; 2/79

[58] Field of Search ..... 2/69, 108, 115, 2/227, 228, 238, 102, 79; 482/105, 121, 124, 131, 74; 450/104

[56] References Cited

U.S. PATENT DOCUMENTS

| | | |
|---|---|---|
| 1,178,165 | 8/1916 | Lupton . |
| 2,097,376 | 10/1937 | Marshman . |
| 2,613,932 | 10/1952 | Manners . |
| 3,411,500 | 11/1968 | Gatts . |
| 3,559,654 | 2/1971 | Pope . |
| 3,759,510 | 9/1973 | Jackson . |
| 4,065,814 | 1/1978 | Fox . |
| 4,220,299 | 9/1980 | Motter . |
| 4,325,379 | 4/1982 | Ozbey . |
| 4,384,369 | 5/1983 | Prince . |
| 4,670,913 | 6/1987 | Morell . |
| 4,698,847 | 10/1987 | Yoshihara . |
| 4,910,802 | 3/1990 | Malloy . |
| 4,953,856 | 9/1990 | Fox . |
| 4,961,573 | 10/1990 | Wehrell . |
| 4,968,028 | 11/1990 | Wehrell . |
| 4,993,705 | 2/1991 | Tolle . |
| 5,033,123 | 7/1991 | Audet . |
| 5,046,194 | 9/1991 | Alaniz . |
| 5,060,315 | 10/1991 | Ewing . |
| 5,062,642 | 11/1991 | Berry . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | Maclean . |
| 5,256,119 | 10/1993 | Tudor . |
| 5,263,916 | 11/1993 | Bobich . |
| 5,267,928 | 12/1993 | Barile . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | LaCourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |
| 5,700,231 | 12/1997 | Wilkinson ..... 482/124 |
| 5,708,976 | 1/1998 | Dicker ..... 2/69 |
| 5,720,042 | 2/1998 | Wilkinson ..... 2/69 |
| 5,727,254 | 3/1998 | Dicker ..... 2/69 |
| 5,737,773 | 4/1998 | Dicker et al. ..... 2/69 |
| 5,745,917 | 5/1998 | Wilkinson et al. ..... 2/69 |

*Primary Examiner*—Gloria M. Hale
*Attorney, Agent, or Firm*—Connolly & Hutz

[57] ABSTRACT

An energy expenditure garment is made from a base fabric and includes a plurality of elongated elastic resistance elements preferably in the form of elongated elastic resistance elements preferably in the form of bands which extend posteriorly and anteriorly along the arms and extend on the chest and at the back of the wearer in the area of the shoulders. Lateral and medial bands also extend down the legs of the user. The garments are particularly designed for use in skating. Novel wrist band structure is also disclosed.

21 Claims, 3 Drawing Sheets

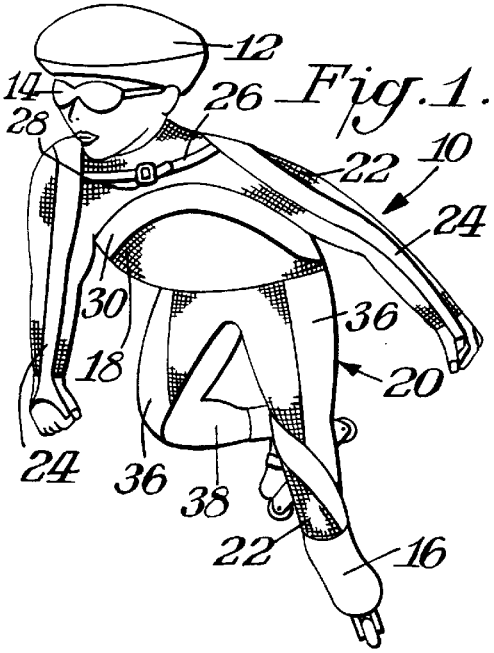
Fig. 1.
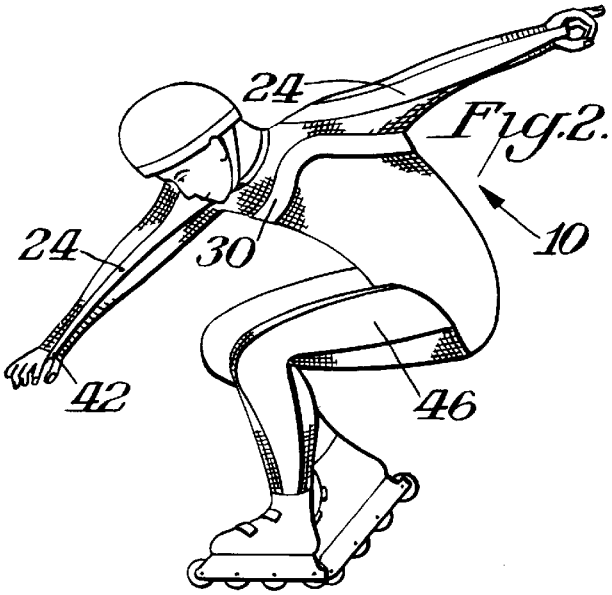
Fig. 2.
Fig. 1A.
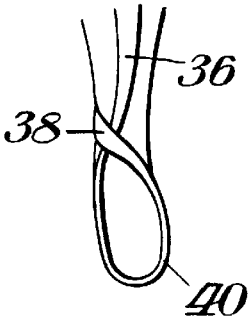
Fig. 3.
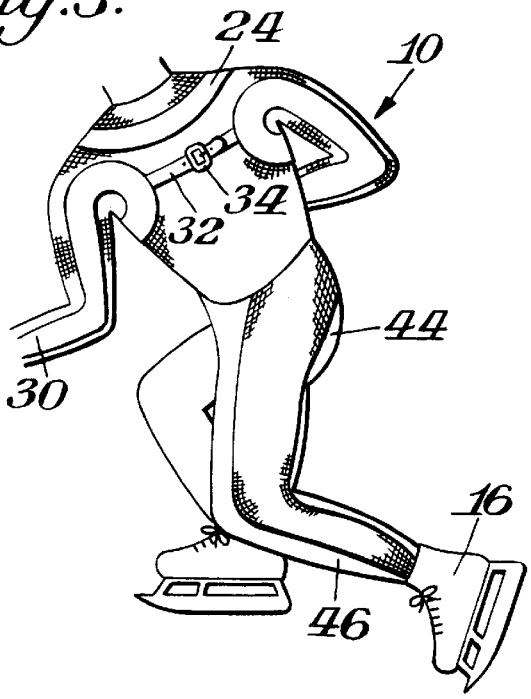

ENERGY EXPENDITURE GARMENT

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546; 5,176,600; 5,186,701; 5,201,074; 5,306,222 and 5,570,472. Additional disclosures of such garments are found in various U.S. patent applications, namely, Ser. No. 08/627,426, filed Apr. 4, 1996, now U.S. Pat. No. 5,700,231; Ser. No. 08/660,098, filed Jun. 6, 1996, now U.S. Pat. No. 5,727,254; Ser. No. 08/734,736, filed Oct. 21, 1996, now U.S. Pat. No. 5,708,976; Ser. No. 08/761,290, filed Dec. 6, 1996, now U.S. Pat. No. 5,720,042; Ser. No. 08/777,455, filed Dec. 3, 1996, now U.S. Pat. No. 5,745,917; Ser. No. 08/802,972, filed Feb. 20, 1997, now U.S. Pat. No. 5,737,772; Ser. No. 08/802,973, filed Feb. 20, 1997, now U.S. Pat. No. 5,737,773; Ser. No. 08/834,887, filed Apr. 7, 1997, Ser. No. 08/840,917, filed Apr. 25, 1997; and Ser. No. 08/880,775, filed Jun. 23, 1997, in the names of Timothy Dicker and William T. Wilkinson and entitled ENERGY

SUMMARY OF THE INVENTION

An object of this invention is to provide an energy expenditure garment which is particularly adapted for use in various types of skating, such as rollerblading, ice skating and roller skating.

A further object of this invention is to provide an energy expenditure garment with novel cuff structure for anchoring the elastic elements.

In accordance with this invention an energy expenditure garment is formed from a base material with a plurality of elastic resistance elements secured to the base material. The elastic resistance elements are made of a material requiring a greater force to stretch the resistance elements and resist the elements from returning to their original stretch condition than would be the force required for the base material. The plurality of elastic resistance elements may include a chest band and a band which extends on each arm anteriorly and then over the shoulder posteriorly. The elastic resistance elements may also include an anterior band below the chest which extends to the back of the garment and then forms posterior arm bands. In addition, the elastic resistance elements may include a large lateral band extending down each leg. The bands and particularly the arm bands may be anchored by cuffs, such as at the wrists. In a preferred practice of the invention each cuff has a pair of free ends which are detachably secured together to form an endless band. Such detachable securement could be by a fastener such as a zipper or by adjustable fasteners such as VELCRO or buckles.

THE DRAWINGS

FIG. 1 is a pictorial front view showing a user with an energy expenditure garment with the user wearing roller blades;

FIG. 1A is an enlarged view of a pants stirrup;

FIG. 2 is a view similar to FIG. 1 of a modified garment;

FIG. 3 is a view similar to FIG. 1 showing the posterior portion of the garment with the user wearing ice skates;

DETAILED DESCRIPTION

Figure 4:
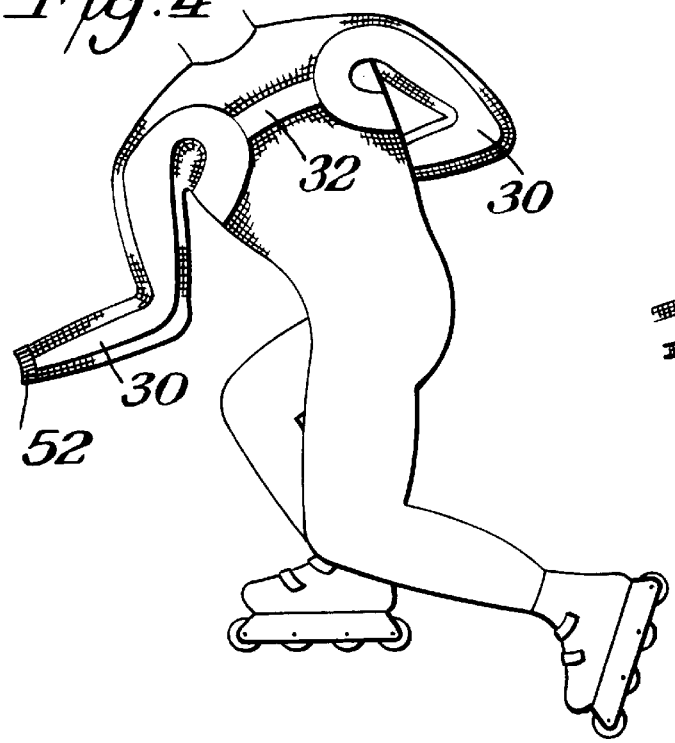
FIG. 4 is a view similar to FIG. 3 of a modified form of garment.

The present invention relates to variations in the form of energy expenditure garments which could be of the types shown and described in the aforenoted patents and applications. All of the details of those patents and applications are incorporated herein by reference thereto. The present invention in one aspect particularly relates to such garments which are designed for use in skating, namely, in-line skating or rollerblading or for ice skating and roller skating. In these various forms of skating the user generally makes the same form of physical movements in the type of bending and muscle use for such skating.

As later described another aspect of the invention relates to the manner of anchoring various resistance bands such as to the ankles or wrists preferably by an endless cuff.

In a preferred practice of the invention the garment has arm sections, although the invention may be broadly practiced without incorporating any elastic resistance elements on the arm section or even by omitting the arm sections completely. Where elastic resistance elements are provided on the arms the elements are anchored by being attached to a glove or looped around the hand. Preferably, however, the elements are anchored to wrist bands or cuffs. Similarly, the legs could be attached to an article of footwear or to a stirrup or to an ankle loop which could be similar to the wrist band. The leg portions can be of any length, but preferably extend to at least the knee and more preferably to the feet. Because in a preferred practice of the invention the garment is used in skating, the attachment of the elastic leg bands could be directly to the skate, i.e. ice skate, in-line skate, roller skate. Such attachment could be in any suitable manner, and should be detachable such as by clips, snaps, harnesses, etc.

As the user skates the user will move against the resistance elements and thus expend more energy thereby increasing the workout or exercise.

The invention in general relates to a type of clothing comprising one or more members to form a garment. Thus, for example the garment could be a single piece suit or a suit made from separate shirt and pants portions which could be detachably secured together or could remain separate from each other. Where such separate shirt and pants portions are used it is preferred to provide anchoring structure at the waist for any elastic element that might extend up the legs or down the body portion.

The garment itself is made of a base fabric with a plurality of resistance structures, preferably elastic structures incorporated into the body of the garment. These structures could be of any suitable material and/or design such as disclosed in the aforenoted patents and applications. Preferably, the resistance elements are elastic bands or strips that are woven or sewn into the body of the garment by physical connection to the base material. The elastic bands can be adjustable or could be non-adjustable as to their tension. In the preferred practice of the invention the bands are adjustable in tension to provide the user with the ability to maximize comfort and obtain the desired precise level or degree of resistance. The base fabric for the garment could be of any material including non-elastic materials. Preferably, however, the base fabric is made of an elastic or stretch material that offers much less resistance than the resistance encountered from the elastic bands. The elastic/stretch characteristics of the base fabric helps to address problems of fit and comfort while providing support. The elastic resistance garment could be used for general exercise or for specific sports training or in actual sports competition. The garment could even be used for casual wear. The preferred practice of the invention, however, is in sports participation wherein the sport is a skiing or skating sport, such as ice skating or roller skating or rollerblading (in-line skating).

All of the above skating type activities have a similar motion involving the arms and legs and utilize a pair of skates/blades that make the activity distinctive. Skiing has similar motion. The invention addresses the desirability of providing a way to increase the amount of resistance benefit when engaged in one of the various activities by addressing the muscles that are used therein. Such activities involve gliding or rolling on wheels or blades and can be done without the expenditure of a large amount of energy depending upon the form or technique the invention provides a garment which locates the elastic resistance elements to maximize the energy expenditure benefits.

FIG. 1 illustrates a garment 10 in accordance with this invention particularly designed for use during skating. As shown therein the user would wear conventional equipment such as a helmet 12, goggles 14 and the skates 16 which are illustrated as in-line skates or roller blades. It is to be understood, of course, that the garment 10 could be worn with other types of skates such as roller skates or ice skates. As shown therein the garment 10 includes a upper body or torso portion 18 and a pants portion 20. Each of these portions is made of a base fabric 22 as previously described. In accordance with this invention a plurality of elongated elastic resistance elements is also provided in both the upper body portion 18 and pants portion 12. As illustrated these elastic resistance elements include a band 24 which extends anteriorly up each arm and extends around the back over the shoulder area of the wearer. The band 24 from each arm could be interconnected by a chest band 26 which is illustrated as being adjustable by means of any suitable fasteners. In the illustrated form a buckle 28 is used for adjustability. Other types of fasteners could be VELCRO, hook and loop fasteners or adhesive fasteners.

As also shown in FIG. 1, a further elongated resistance element includes an anterior band 30 which extends to the back and forms posterior arm bands on portions of the arms opposite the anterior bands 24. FIG. 3, for example, illustrates the posterior of the garment 10 which shows the posterior arm bands 30 that extend to the anterior portion at the front of the garment. Similarly, FIG. 3 illustrates the band 24 along the shoulder of the user posteriorly which is part of the anterior arm bands. FIG. 3 also illustrates the bands 30 to be inter-connected by a further elastic resistance scapular band 32 having an adjustable connection such as by fastener 34 illustrated as a buckle.

The pants portion 20 includes a number of elastic resistance elements. As illustrated these elements include large lateral bands 36 extending along each leg. Such bands may be, for example, 8 inches wide and take in the anterior muscle groups. In addition, a medial maximum leg resistance band 38 is provided on each leg which crosses the knee or can extend straight down to form stirrups with the lateral band 36 as illustrated, for example, in FIG. 1A which shows the bands 36,38 interconnected to form the stirrup 40.

The garment 10 illustrated in FIG. 2 shows variations in the number and location of elastic resistance elements. In this respect the chest band 26 is omitted which interconnects the bands 24,24 of FIG. 1. Further the anterior chest band 30 is located higher in the front of the garment.

As also shown in FIGS. 1–2 the band 24 extending on the anterior of each arm may be interconnected with the posterior band 30 to form a hand loop 42 for anchoring both arm bands.

As shown in FIG. 3 a variation of the leg bands includes having vertical posterior bands 44 extend from the waist completely down the leg with lateral anterior bands 46 also extending straight down the legs. As with the embodiment of FIG. 1 the bands 44 and 46 may be interconnected to form stirrups. FIG. 3 also shows a different form of skate 16 in the form of ice skates.

FIG. 4 illustrates a garment similar to that of FIG. 3 except that as shown the scapular band 32 which interconnects the posterior arm bands 30 is not adjustable.

Figure 5:
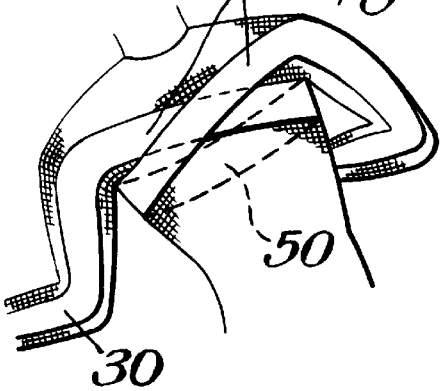
FIG. 5 is a view similar to FIGS. 3–4, but in fragmental form of still yet another form of garment.

FIG. 5 illustrates a variation to the embodiment of FIGS. 3–4 wherein the posterior arm bands 30 cross each other at the back of the garment as indicated by the reference numeral 48. The band portions 48 then extend across the front of the garment to form a chest band 50 shown in phantom in FIG. 5.

As shown in FIG. 4 the arm bands could be anchored by means of a wrist cuff 52 rather than a hand loop. FIGS. 6–9 show variations of wrist cuffs. Preferably, the wrist cuff would have some form of adjustability in its circumference to function as an anchoring cuff. In the preferred practice of the invention the wrist cuff is made of a compressive material in the sense that the direction of contraction is circumferential rather than longitudinal so as to fit snugly around the wrist and thus function as an anchoring element.

Figure 6:
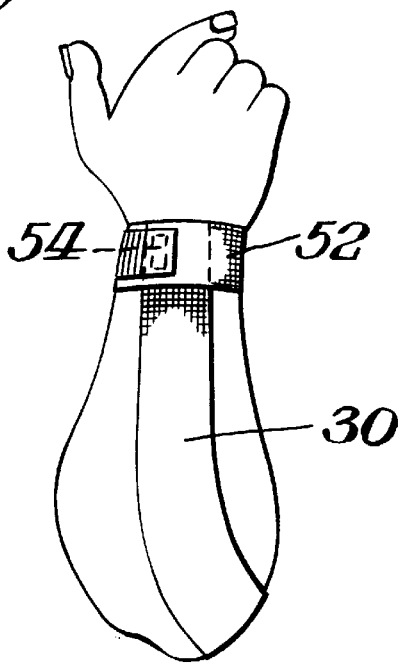
FIG. 6 is a front elevational view showing one manner of anchoring the arm bands to a wrist cuff.

FIG. 6 illustrates one form of wrist cuff 52. As shown therein the wrist cuff 52 is in the form of a band made of compressive material which has a pair of free ends. The free ends overlap each other and are secured together to form a closed loop. Any suitable manner of attachment may be used. As illustrated the attachment is by means of VELCRO or hook and loop formations 54. Other forms include snap fasteners, buckles, buttons, etc. The compression band 52 is, for example, three inches wide and six inches long and made of a suitable elastic material such as neoprene. Other suitable materials include LYCRA™(spondex). Advantageously the band 52 has the additional function of being a sweat band. As shown therein one of the longitudinal elastic resistance elements or bands 30 is anchored to wrist band 52. The other elongated resistance element or band 24 would be anchored to the opposite side of compression band 52.

Figure 7:
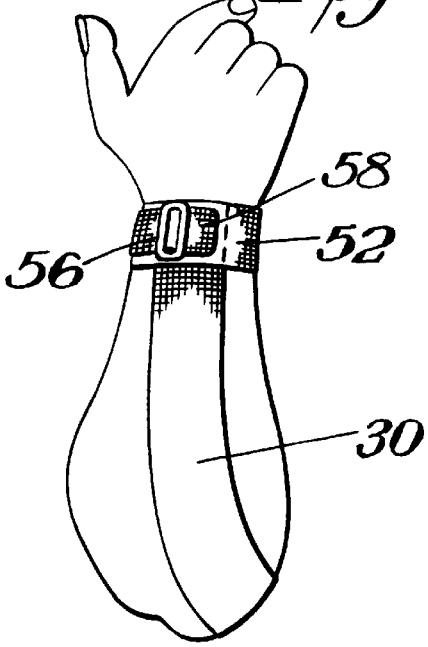
FIGS. 7–9 are views similar to FIG. 6 showing modified forms of anchoring.

FIG. 7 illustrates a variation where the wrist cuff 52 has its free ends secured together by a buckle 56. As shown in FIG. 7 one end 58 of the wrist cuff 52 would be of narrower dimension than the other free end so that the narrow free end 58 functions as an adjusting tab which is engaged with buckle 56. Buckle 56 would be permanently secured to the opposite free end of band 52.

Figure 8:
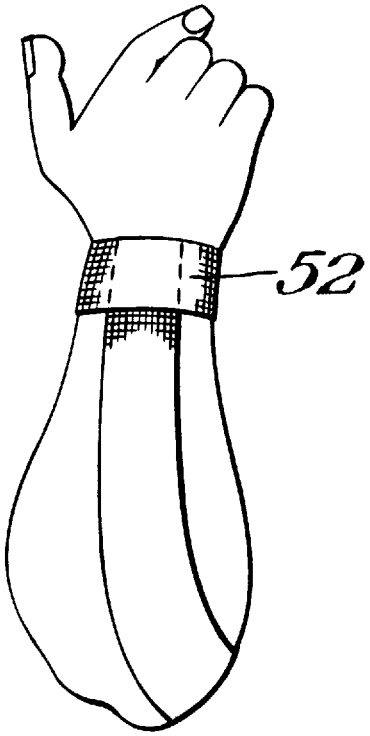

FIG. 8 shows a variation where there is reliance on the elasticity or stretchability of the wrist cuff 52 so that it forms a permanent endless band rather than having a pair of free ends.

Figure 9:
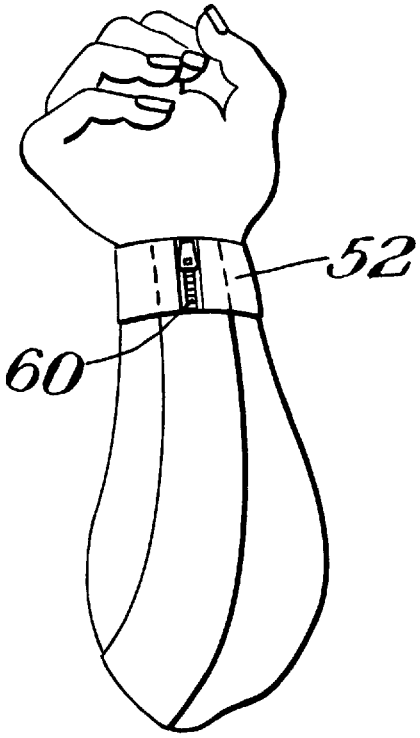

FIG. 9 illustrates yet another variation of the invention wherein the band 52 has its free ends secured together by means of a zipper 60.

It is to be understood that the various wrist cuffs may include elastic sections rather than having the entire band being made of elastic material since an elastic section, such as might comprise one-half of the band, would permit sufficient stretch-ability for proper wrist sizing. It is also to be understood that such anchoring band features as used for the wrist band may also be used as an ankle band for anchoring the elongated resistance elements of the legs. The use of a wrist band would provide the ability to anchor the elastic resistance elements of the arms at only one location, namely at the wrist and would simplify the garment by avoiding mid-hand anchor elements such as the hand loops 42.

The feature of the wrist bands or ankle bands could be incorporated as anchoring elements for energy expenditure garments in general and is not limited to use in such garments intended for skating purposes.

Although the various garments illustrated herein are shown to be of two piece construction the invention may be practiced by having the garment in the form of a one piece suit. Preferably, where either one or two piece construction is used the upper ends of the leg bands would be anchored at the waist such as to a waistband preferably made of a compressive material. The waist-band could also utilize the various structures illustrated and described with respect to the wrist bands.

What is claimed is:

1. An energy expenditure garment comprising a body portion having downwardly extending legs and having a torso portion with outwardly extending arms, said body portion being made of a base material, a plurality of elongated elastic resistance elements secured to said base material, said elastic resistance elements being made of a material requiring a greater force to stretch said resistance elements and to resist said resistance elements from returning toward their unstretched condition than is required for said base material, said plurality of said elastic resistance elements including an anterior chest band and a posterior scapular band and lateral bands extending downwardly of each leg and medial bands extending downwardly of each leg, said chest band extending posteriorly down said arms of said torso portion, said elastic elements further including anterior arm bands, anchoring structure anchoring said arm bands, and further anchoring structure anchoring said lateral and medial leg bands.

2. The garment of claim 1 including a chest band interconnecting said anterior arm bands.

3. The garment of claim 2 wherein said scapular band interconnects said posterior arm bands.

4. The garment of claim 3 wherein said chest band is adjustable in length.

5. The garment of claim 4 wherein said scapular band is adjustable in length.

6. The garment of claim 3 wherein said posterior arm bands cross each other posteriorly at the back of said garment to comprise said scapular band, and said scapular band extends across the front of said garment to comprise said anterior chest band.

7. The garment of claim 3 in combination with skates which extend to at least the end of said legs.

8. The garment of claim 7 wherein said skates comprise roller blades.

9. The garment of claim 7 wherein said skates comprise ice skates.

10. The garment of claim 7 wherein said skates comprise roller skates.

11. The garment of claim 3 wherein said anchoring structure comprises a hand loop.

12. The garment of claim 3 wherein said anchoring structure comprises a wrist band.

13. The garment of claim 12 wherein said wrist band is a compressive wrist band having a pair of free ends which are detachably secured together.

14. The garment of claim 13 wherein said free ends are detachably secured together by a buckle.

15. The garment of claim 14 wherein said free ends are detachably secured together by a zipper.

16. The garment of claim 3 wherein said further anchoring structure comprises said lateral band and said medial band being connected together to form stirrups.

17. An energy expenditure garment comprising a body portion having downwardly extending legs and outwardly extending arms, said body portion being made of a base material, a plurality of elastic resistance elements secured to said base material, said elastic resistance elements being made of a material requiring greater forces of stretch said resistance elements and to resist said resistance elements from returning toward their original unstretched condition than is required for said base material, said plurality of elastic resistance elements including arm bands and legs bands, anchoring structure for said arm bands and said leg bands, said anchoring structure including at least one compression band, said compression band having a pair of free ends, and detachable fastening means securing said free ends together to form an endless loop.

18. The garment of claim 17 wherein said detachable securing means comprises a buckle.

19. The garment of claim 17 wherein said detachable securing means comprises hook and loop structure.

20. The garment of claim 17 wherein said detachable securing means comprises a zipper.

21. The garment of claim 17 wherein said anchoring structure for each of said arm bands comprises said compression band.

* * * * *